US006702188B2

(12) United States Patent
Yano et al.

(10) Patent No.: US 6,702,188 B2
(45) Date of Patent: Mar. 9, 2004

(54) EXPANSION VALVE

(75) Inventors: Masamichi Yano, Tokyo (JP); Daisuke Watari, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/190,492

(22) Filed: Jul. 9, 2002

(65) Prior Publication Data

US 2003/0010834 A1 Jan. 16, 2003

(30) Foreign Application Priority Data

Jul. 12, 2001 (JP) ..... 2001-211690
Dec. 28, 2001 (JP) ..... 2001-400573

(51) Int. Cl.[7] ..... F25B 41/04; G05D 27/00
(52) U.S. Cl. ..... 236/92 B; 62/222; 251/64
(58) Field of Search ..... 236/92 B; 251/64; 137/901; 62/225, 222

(56) References Cited

U.S. PATENT DOCUMENTS 4,452,852 A 9/1984 Orht et al.
4,531,542 A * 7/1985 Looney ..... 137/514.7
5,033,505 A * 7/1991 Eidsmore ..... 137/505.39
5,303,864 A * 4/1994 Hirota ..... 236/92 B
5,950,984 A * 9/1999 Anderson et al. ..... 251/129.14
6,029,694 A 2/2000 Schwegler et al.
6,145,753 A * 11/2000 Yano et al. ..... 236/92 B
6,202,979 B1 * 3/2001 Wolfgang et al. ..... 251/50
6,431,209 B1 * 8/2002 Weiler, Jr. ..... 137/596.17
6,488,264 B2 * 12/2002 Wiklund ..... 251/218

FOREIGN PATENT DOCUMENTS

GB 540 730 A1 10/1941
JP 09-222268 8/1997
JP 2001-050422 2/2001
JP 2001-050617 2/2001
JP 2001-082835 A1 3/2001
JP 2001-141335 5/2001

* cited by examiner

*Primary Examiner*—William E. Tapolcai
*Assistant Examiner*—Mohammad M. Ali
(74) *Attorney, Agent, or Firm*—Rader, Fishman & Grauer PLLC

(57) ABSTRACT

The valve body has an orifice that provides communication between a high-pressure side passage through which a cooling medium flows in and a low-pressure side passage through which the cooing medium flows out. Also, the valve is provided with a valve element that adjusts the volume of the cooling medium passing through this orifice, an operating rod that operates the valve element in the valve opening position, and a temperature-sensing drive section that drives this operating rod. On the upstream side of the orifice of the high-pressure side passage is disposed a support ring that constrains the ball-shaped valve element of the valve body.

10 Claims, 6 Drawing Sheets

EXPANSION VALVE

BACKGROUND OF THE INVENTION

1. Field of the Invention

The present invention relates to an expansion valve that constitutes a refrigerating cycle.

2. Description of the Prior Art

Although there are various types of expansion valve, widely used is an expansion valve in which a valve element is disposed, from the upstream side, opposite to an orifice which is formed by narrowing a high-pressure cooling medium passage, through which a high-pressure cooling medium to be fed into an evaporator flows, and the valve element is caused to perform opening and closing operation in response to the temperature and pressure of a low-pressure cooling medium discharged from the evaporator.

An expansion valve of this type can be used in a refrigerating cycle 1 in an air conditioner or the like of an automobile, as shown in FIG. 11. This refrigerating cycle 1 is composed of a cooling medium compressor 2 driven by an engine, a condenser 3 connected to the cooling medium compressor 2 on the discharge side thereof, a receiver 4 connected to the condenser 3, and an expansion valve 5 that causes the liquid-phase cooling medium from the receiver 4 to expand adiabatically so as to convert it into a gas-liquid two-phase cooling medium, and an evaporator 6 connected to the expansion valve 5. The expansion valve 5 is positioned within the refrigerating cycle 1.

The expansion valve 5 is provided with a high-pressure side passage 5*b,* through which the liquid-phase cooling medium flows into the valve body 5*a,* and a low-pressure side passage 5*c,* through which the gas-liquid two-phase cooling medium that has adiabatically expanded flows out. The high-pressure side passage 5*b* and low-pressure side passage 5 communicate with each other via an orifice 7. Furthermore, the expansion valve 5 is provided, in a valve chamber 8*d* thereof, with a valve element 8 that adjusts the volume of the cooling medium passing through the orifice 7.

A low-pressure cooling medium passage 5*d* pierces through the valve body 5*a* of the expansion valve 5. Furthermore, a plunger 9*a* is slidably disposed within this low-pressure cooling medium passage 5*d*. This plunger 9*a* is driven by a temperature-sensing drive section 9 fixed to the upper part of the valve body 5*a*. The interior of this temperature-sensing drive section 9 is divided by a diaphragm 9*d* so that an upper airtight chamber 9*c* and a lower airtight chamber 9*c*' are formed in the temperature-sensing drive section 9. A disk portion 9*e* at the top end of the plunger 9*a* abuts against the diaphragm 9*d*.

Furthermore, a compression coil spring 8*a,* which presses the valve element 8 via a support member 8*c* in the valve closing direction, is disposed within the valve chamber 8*d* in the lower part of the valve body 5*a*. This valve chamber 8*d* is blocked by an adjusting screw 8*b* screwed into the valve body 5*a* and is held in an airtight condition by an O-ring 8*e*.

Also, an operating rod 9*b* that moves in the valve opening direction by the sliding action of a plunger 9*a* abuts against the bottom end of the plunger 9*a*.

And the plunger 9*a* in the temperature-sensing drive section 9 transmits the temperature in the low-temperature cooling medium passage 5*d* to the upper airtight chamber 9*c*. The pressure of the upper airtight chamber 9*c* changes in response to the transmitted temperature. For example, when the temperature transmitted to the upper airtight chamber 9*c* is high, the pressure of the upper airtight chamber 9*c* increases so that the diagram 9*d* pushes the plunger 9*a* down. As a result, the valve element 8 moves in the valve opening direction so that the volume of the cooling medium passing through the orifice 7 increases, whereby the temperature of the evaporator 6 is lowered.

On the other hand, when the temperature transmitted to the upper airtight chamber 9*c* is low, the pressure of the upper airtight chamber 9*c* drops, the force for pushing the plunger 9*a* down by means of the diagram 9*d* becomes weak, and the valve element 8 moves in the valve closing direction due to the action of the compression coil spring 8*a,* which presses the valve element 8 in the valve closing direction, with the result that the volume of the cooling medium passing through the orifice 7 decreases and that the temperature of the evaporator 6 is raised.

In this manner, according to the temperature change in the low-pressure cooling medium passage 5*d,* the expansion valve 5 moves the valve element 8 to change the opening area of the orifice 7 and adjust the volume of the cooling medium passing through the orifice 7, thereby adjusting the temperature of the evaporator.

And in the expansion valve 5 of this type, the relationship between the temperature in the low-pressure cooling medium passage 5*d* and the opening area of the orifice 7 which causes the liquid-phase cooling medium to expand adiabatically so as to convert it into a gas-liquid two-phase cooling medium can be set by adjusting the spring load of the compression coil spring 8*a* which presses the valve element 8 in the valve closing direction, by adjusting the screw-in amount of the adjusting screw 8*b*.

However, pressure fluctuations in the high-pressure cooling medium fed into the expansion valve may sometimes occur on the upstream side in the refrigerating cycle, and these pressure fluctuations are transmitted to the expansion valve with the high-pressure cooling medium liquid serving as a medium.

Then, in a conventional expansion valve as described above, when the cooling medium pressure on the upstream side is transmitted to the valve element by pressure fluctuations, the pressure fluctuations may sometimes pose the problem that the operation of the valve element become unstable. In this case, the flow control of the expansion valve is not accurately performed. Or this may sometimes cause the irregularity that the vibration of the valve element produces noise.

As a measure to solve this problem, there has been proposed a technique in which a spring gives an urging force sideways to a rod which is disposed so as to freely move forward and backward in an axial direction between a power element and a valve element so that an operation is stabilized (see Japanese Patent Application Laid-Open No. 2001-141335).

With the conventional technique mentioned above, however, although the purpose of coping with pressure fluctuations of a high-pressure cooling medium for stabilization of operation is achieved, the spring that pushes sideways the rod which moves forward and backward in an axial direction must be arranged in a stable condition, so that there is a fear of requiring high cost because of a complex structure and assembly work.

OBJECTS AND SUMMARY OF THE INVENTION

The object of the invention is to provide an expansion valve which enables stable operation against pressure fluctuations of a high-pressure cooling medium using simple and inexpensive means.

In order to achieve the above-described object, the expansion valve of the present invention comprises a valve body which has an orifice that provides communication between a high-pressure side passage through which a cooling medium flows in and a low-pressure side passage through which the cooling medium flows out; a valve element that adjusts the volume of the cooling medium flowing through the orifice; an operating rod that operates the valve element in the valve opening direction; and a temperature-sensing drive section that drives the operating rod. This expansion valve further comprises constraining means for constraining the above-described valve element or for constraining support member that is integral with this valve element, which is disposed on the upstream side of the orifice of the high-pressure side passage.

In this constraining means it is possible to adopt the following embodiments:

The constraining means is attached to the above-described valve body.

The constraining means gives a constraining force to the valve element by an elastic force.

The valve element is formed in the shape of a ball, and the constraining means is a support ring that supports the valve element.

The support ring comprises an elastically deformable, annular ring-shaped portion and a vibration-isolating spring. The vibration-isolating spring supports the valve element.

As the expansion valve of the present invention comprises the above-described components, by disposing constraining means of simple structure for constraining the valve element or valve-element support member, on the upstream side of the orifice, it is possible to suppress the vibration of the valve element caused by pressure fluctuations of the cooling medium on the upstream side of the refrigerating cycle.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

First, an embodiment of the expansion valve according to the invention will be described by referring to a partial sectional view of FIG. 1.

Figure 1:
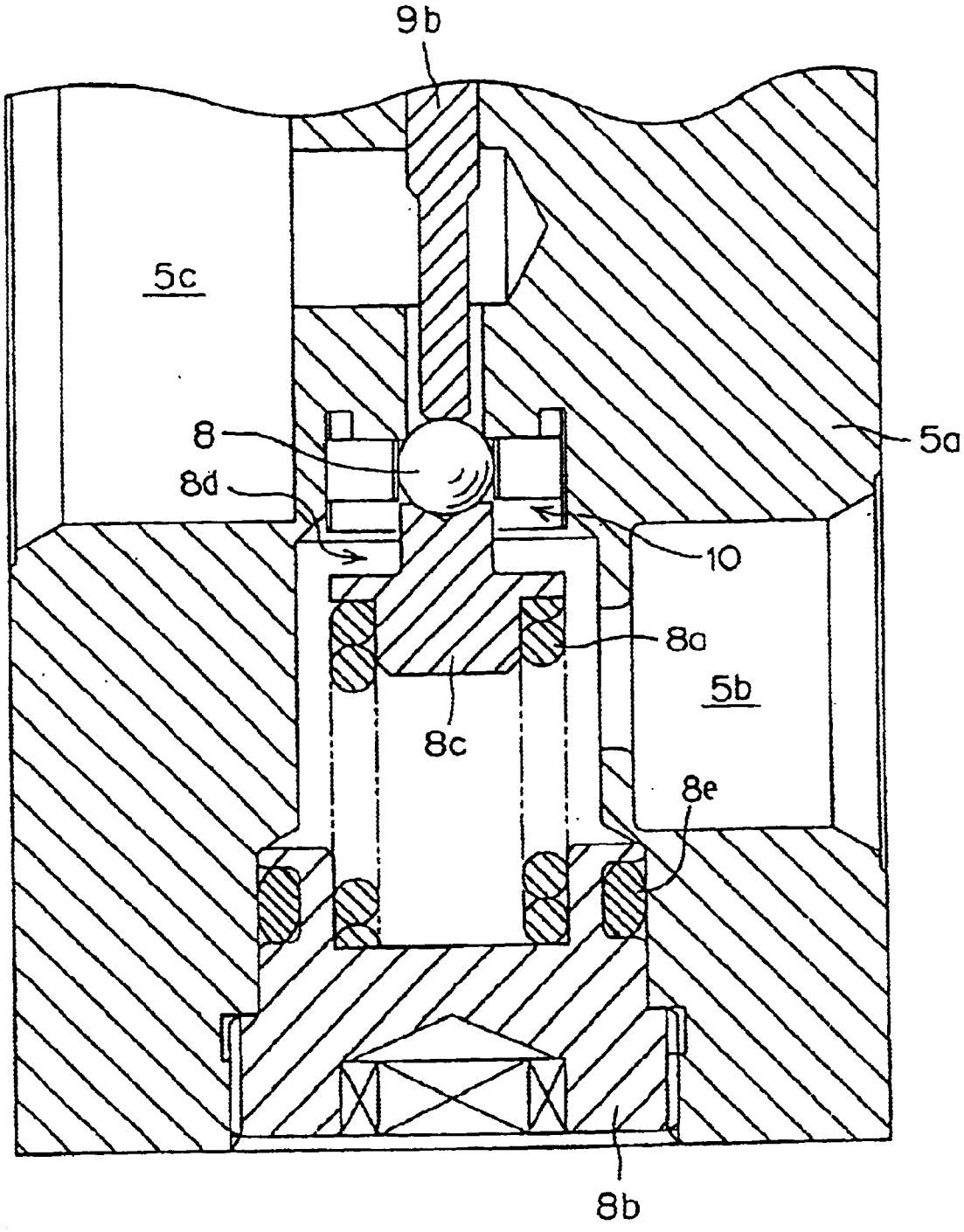
FIG. 1 is a partial sectional view of an expansion valve according to an embodiment of the invention.
Figure 11:
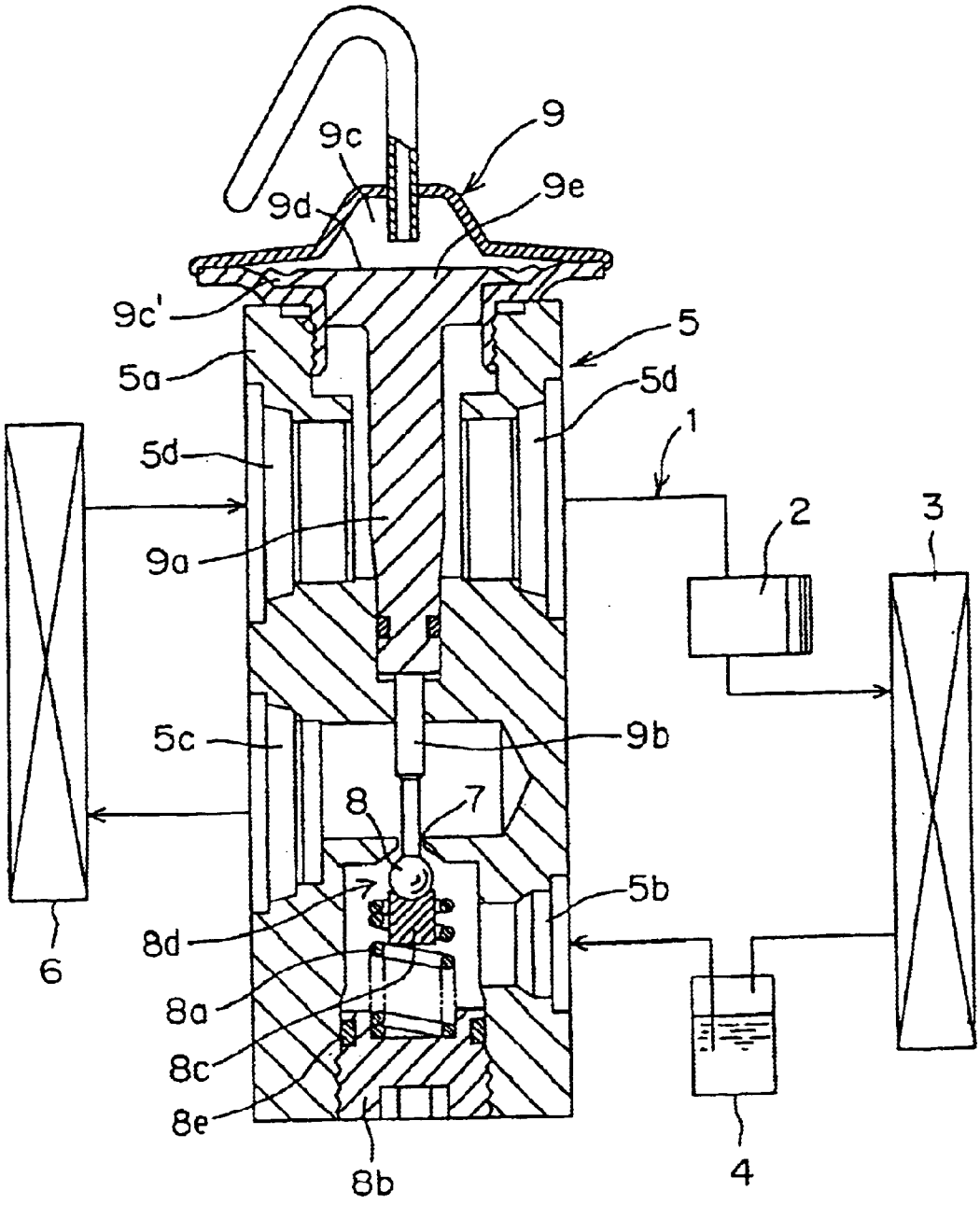
PRIOR ART FIG.11
FIG. 11 is a sectional view of a conventional expansion valve positioned in a refrigerating cycle.

The expansion valve shown in FIG. 1 is characterized in that the circumference of the valve element 8 of conventional expansion valve 5 shown in FIG. 11 is supported by constraining means 10 of a structure which will be described later and, therefore, examples of structure of this constraining means will be mainly described here. In the following explanation of the expansion valve shown in FIG. 1, the same reference numerals are used for the elements identical with those of the expansion valve shown in FIG. 11.

A valve element 8 of an expansion valve 5 is driven by a temperature-sensing drive section 9 that operates in response to the temperature of a low-pressure cooling medium fed from an evaporator 6, so that the flow rate of cooling medium flowing into the evaporator 6 is adjusted. Constraining means 10 (described later) that gives a constraining force to this valve element 8 is fixedly attached in a housing space of a circular section, which is formed in the valve body 5*a* in close vicinity to the valve elements 8. And, with this constraining means 10, the subject of the invention, i.e., elimination of unstable operation of the valve element due to pressure fluctuations of a high-pressure cooling medium, is achieved.

A valve body 5*a* has an orifice 7 that provides communication between a high-pressure side passage 5*b* through which a cooling medium flows in and a low-pressure side passage 5*c* through which the cooling medium flows out, both passages being formed in the expansion valve 5. The volume of the cooling medium flowing through this orifice 7 is adjusted by the opening area of the valve element 8.

The adjustment of the opening area of the orifice by the valve element 8 is performed by the operation of an operating rod 9*b* that operates the valve element 8 in the valve opening direction and of the temperature-sensing drive section 9 that drives this operating rod 9*b*.

On the upstream side of the orifice 7 (or, on the side of the high-pressure side passage 5*b*), constraining means 10 which constrains the valve element 8 is disposed within a valve chamber 8*d*. This constraining means 10 is, as described above, attached in the housing space formed in the valve body 5*a*. Using its elastic force, this constraining means 10 constrains the valve element 8 sideways.

Incidentally, this constraining means 10 is constructed so as not to impede the operation of adjusting the opening area of the orifice 7 by the valve element 8 even when the constraining means 10 constrains the side surface of the valve element 8.

The valve element 8 is formed in the shape of a ball and supported by a support member 8*c* that is integral with the valve element 8. The constraining means 10 comprises a support ring that elastically supports either or both of the valve element 8 or the support element 8*c*. In the following description, the constraining means 10 is referred to as the support ring. The support ring, which serves as constraining means and will be described below, supports the valve element 8 elastically.

A first example of the support ring will be described by referring to FIGS. 2 and 3.

The support ring 10 in this example comprises an annular ring-shaped portion 11, which is formed from a material of steel having high metal elasticity, such as stainless steel, and is capable of elastic deformation, and a plurality of, for example, four vibration-isolating springs 12 of curved plate, which are formed by cutting this ring-shaped portion 11 so as to protrude from the ring-shaped portion 11. Each of the four vibration-isolating springs 12 is formed in a curved shape so that the leading end thereof takes on a convex shape protruding toward the center of the ring-shaped portion 11. And these four vibration-isolating springs 12 elastically support the ball-shaped valve element 8 at the circumference thereof, as shown in FIG. 3.

Furthermore, in the support ring 10, a slit 13 is formed in a part of the ring-shaped portion 11 so that the diameter of the ring-shaped portion 11 can be reduced during mounting in the housing space of the valve body 5*a*.

According to the support ring 10 of this structure, when the ring-shaped portion 11 is mounted in the housing space of the valve body 5*a,* the valve element 8 is supported by the vibration-isolating springs 12 at four places in the circumference. Thus, the support ring 10, which functions as the constraining means of the valve element 8, can stabilize the operation of the valve element 8 even when fluctuations in the cooling medium pressure occur in the refrigerating cycle and hence it is possible to perform accurate control of the flow rate of cooling medium and to prevent the production of noise due to the vibration of the valve element 8.

Figure 4:
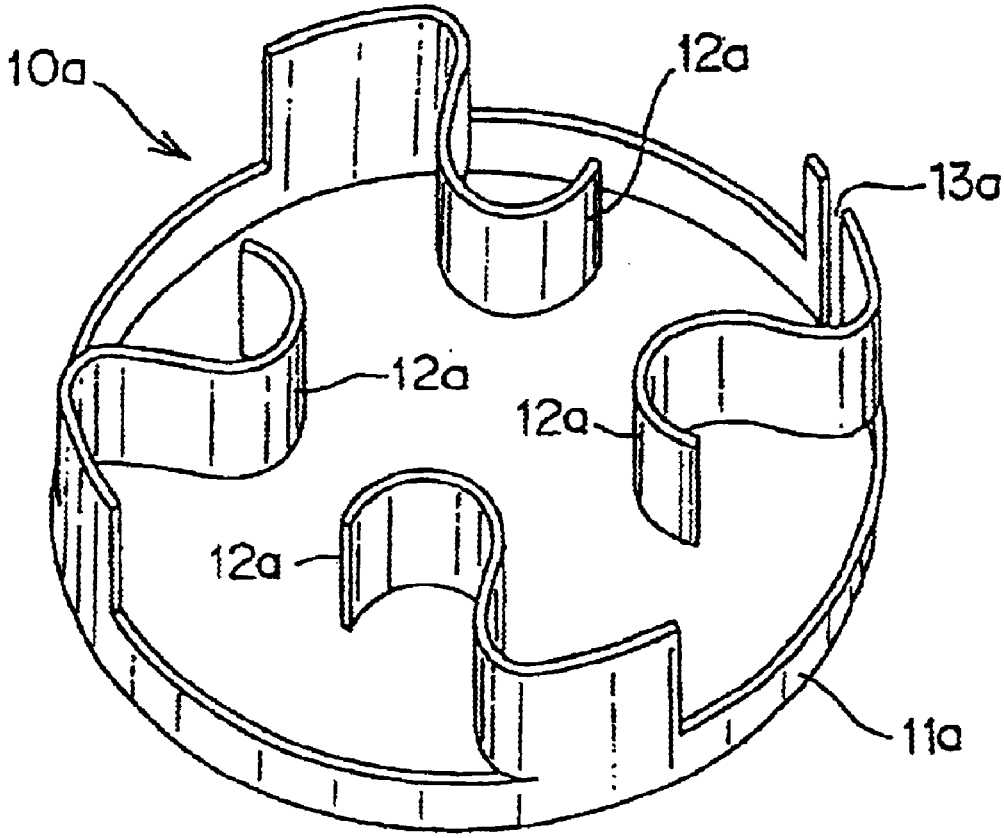
FIG. 4 is a perspective view of a second example of a support ring used in the expansion valve shown in FIG. 1.

A second example of the support ring will be described by referring to FIG. 4.

A support ring 10*a* in this example comprises one annular ring-shaped portion 11*a* and a plurality of vibration-isolating springs 12*a* of plate, which are disposed on one side of this ring-shaped portion 11*a*. Incidentally, in the support ring 10*a,* a slit 13*a* is also formed in a part of the ring-shaped portion 11*a* so that the diameter of the ring-shaped portion 11*a* can be reduced during mounting in the housing space of the valve body 5*a,* in the same manner as in the case of the support ring 10 of the above-described first example.

Each of the vibration-isolating springs 12*a* is formed in a curved shape so that the leading end thereof takes on a convex shape protruding toward the center of the ring-shaped portion 11. The valve element 8 is supported at the circumference thereof by the sides of the leading ends of the vibration-isolating springs 12*a*. In the support ring 10*a* of this example, the vibration-isolating springs 12*a* are formed by cutting the ring-shaped portion 11*a* so as to protrude from this ring-shaped portion 11*a,* in the same manner as in the case of the support ring 10 of the first example.

Figure 2:
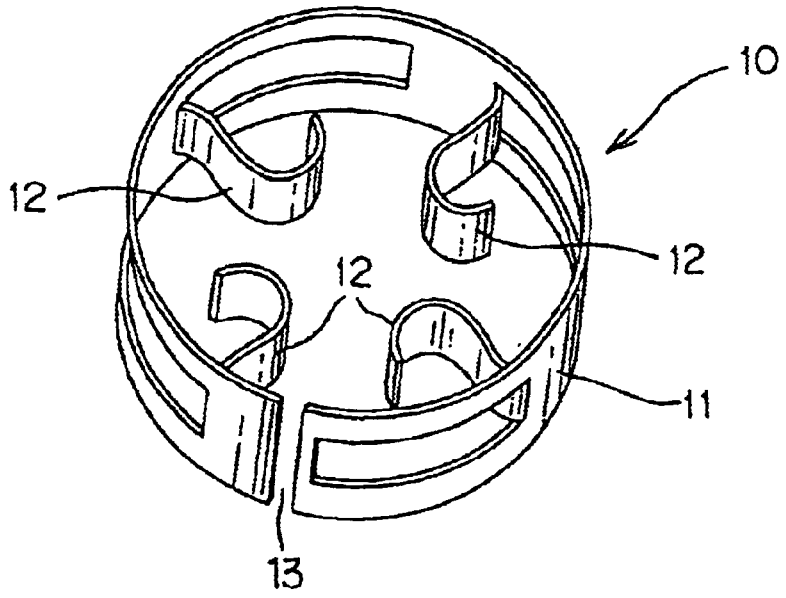
FIG. 2 is a perspective view of a first example of a support ring used in the expansion valve shown in FIG. 1.
Figure 3:
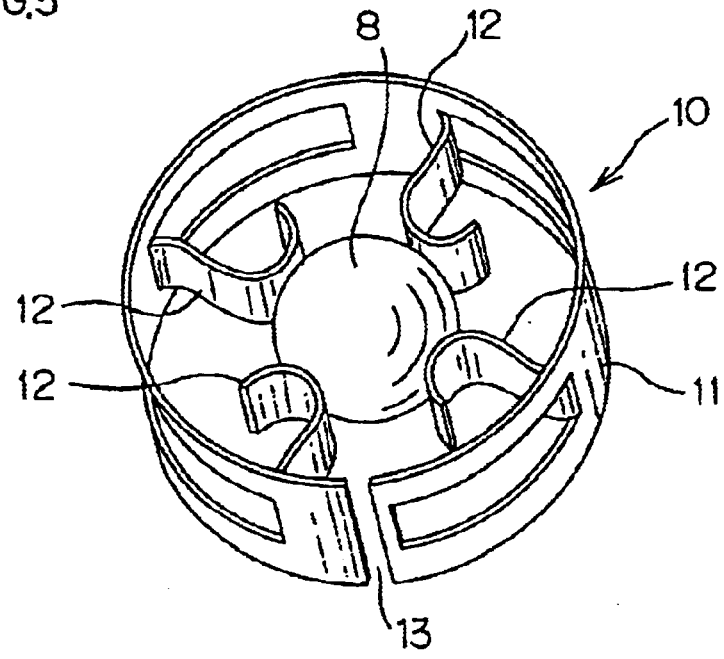
FIG. 3 is a perspective view which shows how the support ring shown in FIG. 2 constrains a valve element.

In the support ring 10*a* of this structure, it is possible to perform accurate control of the flow rate of cooling medium and to prevent the production of noise due to the vibration of the valve element 8 when fluctuations in the cooling medium pressure occur in the refrigerating cycle, in the same manner as in the case of the support ring 10 of the first example (FIGS. 2 and 3).

Figure 6:
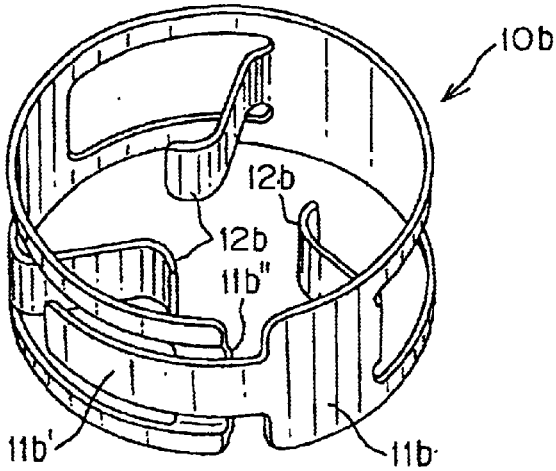
FIG. 6 is a perspective view which shows how the support ring shown in FIG. 5 is attached to the expansion valve.
Figure 7:
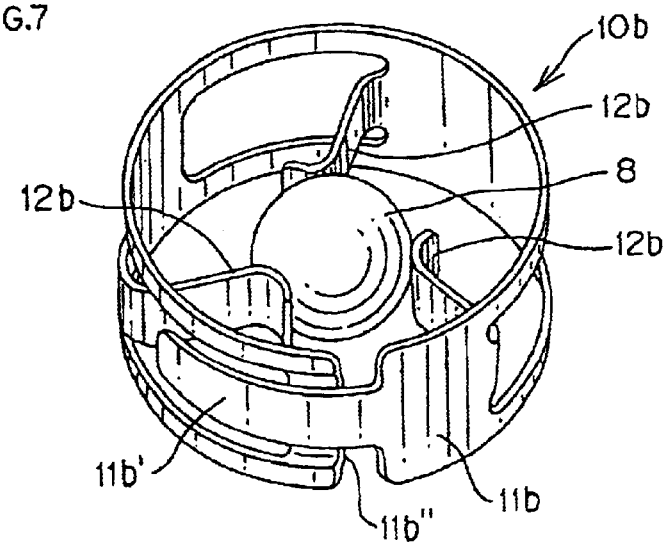
FIG. 7 is a perspective view which shows how the support ring shown in FIG. 6 constrains a valve element.

A third example of the support ring will be described by referring to FIGS. 5 to 7.

In the support ring 10*b* of this example, an overlapping portion is formed at the end portion of a plate forming a ring-shaped portion 11*b,* instead of forming the slit 13, 13*a* in the ring-shaped portion 11, 11*a* of the support ring 10, 10*a* in the above-described first and second examples. As shown in FIG. 5, this overlapping portion is formed by extending a tongue 11*b*' having a narrow width and a prescribed length from one end of a ring-shaped portion 11*b* with the same curvature as the ring-shaped portion 11*b*. On the other hand, a tongue-receiving recess 11*b*", which guides and supports the tongue 11*b*' constituting the overlapping portion, is formed at the other end of this ring-shaped portion 11*b*.

This tongue-receiving recess 11*b*" is formed so as to extend in the circumferential direction in the vicinity to the other end of the ring-shaped portion 11*b* between the upper and lower edge portions. And the depth of the tongue-receiving recess 11*b*" is provided in a manner such that no gap is formed between the ring-shaped portion 11*b* and the inner wall of the housing space formed in the valve body 5*a* when the tongue 11*b*' of the ring-shaped portion 11*b* overlaps the tongue-receiving recess 11*b*" within the housing space. That is, the depth of the tongue-receiving recess 11*b*" is almost the same as or larger than the thickness of the tongue 11*b*'.

Figure 5:
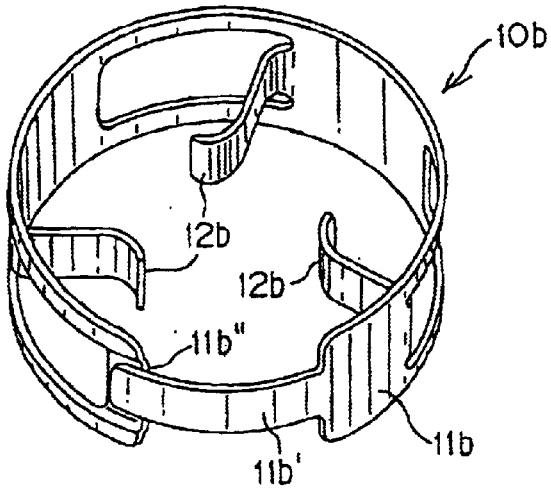
FIG. 5 is a perspective view of a third example of a support ring used in the expansion valve shown in FIG. 1.

In the same manner as in the case of the support ring 10, 10*a* in the above-described first and second examples, the support ring 10*b* of this example comprises also an annular ring-shaped portion 11*b,* which is formed from a material of steel having high metal elasticity, such as stainless steel, and a plurality of, for example, three vibration-isolating springs 12*b* of curved plate, as shown in FIG. 5, which are formed by cutting this ring-shaped portion 11*b* so as to protrude from this ring-shaped portion 11*b*. Each of the vibration-isolating springs 12*b* is formed in a curved shape so that the leading end thereof takes on a convex shape protruding toward the center of the ring-shaped portion 11*b*. And these three vibration-isolating springs 12*b* elastically support the ball-shaped valve element 8 at the circumference thereof, as shown in FIG. 7.

According to the support ring 10*b* of this structure, the valve element 8 is supported by the vibration-isolating springs 12*b* at three places in the circumference, a minimum necessary number of places, when this support ring 10*b* is fixedly attached in the housing space formed in the valve body 5*a*. That is, the support ring 10*b* functions as the constraining means of the valve element 8. As a result, even when fluctuations in the cooling medium pressure occur in the refrigerating cycle, the operation of the valve element 8 can be stabilized and hence it is possible to perform accurate control of the flow rate of cooling medium and to prevent the production of noise due to the vibration of the valve element 8.

Furthermore, as the ring-shaped portion 11*b* has no slit in the support ring 10*b* of this example, this produces the effect that when a large number of support rings 10*b* are packaged or in an automatic mounting process of expansion valves, the support rings 10*b* do not intertwine with each other and the automatic mounting process is smoothly performed.

A fourth example of the support ring will be described by referring to FIGS. 8 to 10.

Figure 8:
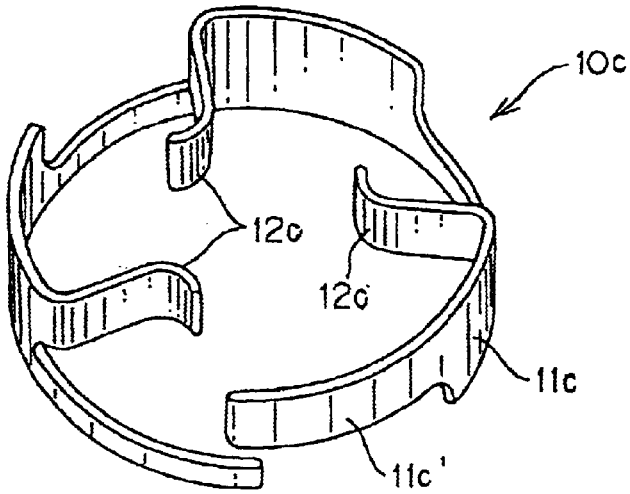
FIG. 8 is a perspective view of a fourth example of a support ring used in the expansion valve shown in FIG. 1.
Figure 9:
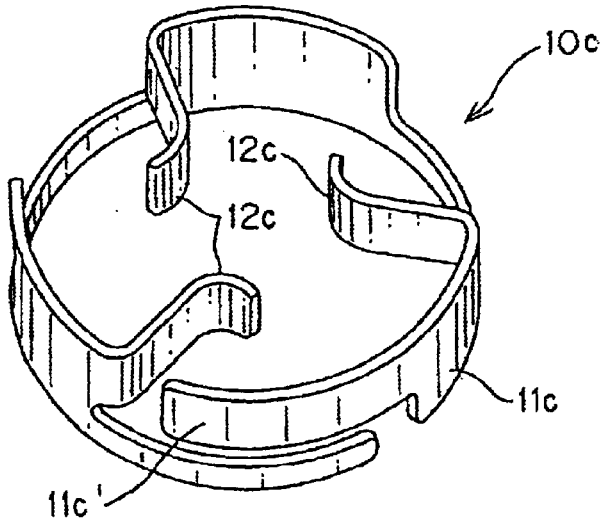
FIG. 9 is a perspective view which shows how the support ring shown in FIG. 8 is attached to the expansion valve.

As shown in FIG. 8, a support ring 10*c* in this example comprises one annular ring-shaped portion 11*c* and three vibration-isolating springs 12*a* of plate disposed on one side of this ring-shaped portion 11*c*. In this support ring 10*c*, an overlapping portion is also formed at the end of the plate forming the ring-shaped portion 11*c*,in the same manner as in the case of the support ring 10*b* in the above-described third example.

This overlapping portion is formed by extending a tongue 11*c*' having a narrow width and a prescribed length from one end of the ring-shaped portion 11*c* with the same curvature as the ring-shaped portion 11*c*. On the other hand, the other end of the ring-shaped portion 11*c* is formed with a narrow width so as to overlap in the same plane as a tongue 11*c*'. Incidentally, the shape, material and number of the vibration-isolating springs 12*c* are the same as those of the support ring 10*b* of the above-described third example.

Figure 10:
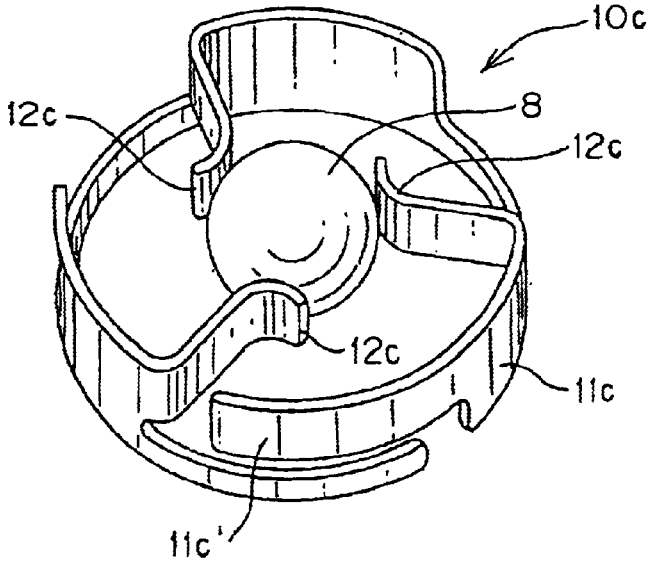
FIG. 10 is a perspective view which shows how the support ring shown in FIG. 9 constrains a valve element.

According to the support ring 10*c* of this structure, the valve element 8 is supported, as shown in FIG. 10, by the vibration-isolating springs 12*c* at three places in the circumference when this support ring 10*c* is fixedly attached in the housing space formed in the valve body 5*a*. That is, this support ring 10*c* functions as the constraining means of the valve element 8. Therefore, even when fluctuations in the cooling medium pressure occur in the refrigerating cycle, the operation of the valve element 8 can be stabilized and hence it is possible to perform accurate control of the flow rate of cooling medium and to prevent the production of noise due to the vibration of the valve element 8.

Although in each of the above-described examples of support ring the vibration-isolating springs 12, 12*a*, 12*b*, 12*c* are formed so as to have the same width along their full length, other shapes may be adopted and it is needless to say that elasticity may be adjusted by forming the vibration-isolating springs in such a manner that the vibration-isolating springs take on a triangular shape in which the leading end portion becomes an apex.

Furthermore, although the slit 13, 13*a* formed in the ring-shaped portion 11, 11*b* of the support ring in the first and second examples is formed so as to vertically cross the support ring 10, 10*a* with respect to the circumferential direction thereof, the slit 13, 13*a* may be formed inclined with respect to the circumferential direction of the support ring 10, 10*a*.

Furthermore, it is needless to say that the overlapping portion formed at the end of the plate that forms the ring-shaped portion 11*b*, 11*c* of the support ring in the third and fourth examples may take on shapes other than those shown in the drawings.

As is apparent from the above-described descriptions, in the expansion valve according to the present invention, which is provided with the above-described components, it is possible to suppress the vibration of the valve element of expansion valve associated with the pressure fluctuations of a cooling medium. Furthermore, as the constraining means provided in the expansion valve is simple in construction and can be easily worked and it is also easy to mount the constraining means in the valve body, it is possible to realize an expansion valve that is easy to handle and very useful.

What is claimed is:

1. An expansion valve in which a valve element adjusts the flow rate of low-pressure cooling medium flowing into an evaporator, said valve element being driven by a temperature-sensing drive section that operates in response to the temperature and pressure of the low-pressure cooling medium fed from the evaporator, said expansion valve comprising:

means for constraining said valve element by giving a constraining force thereto;

a valve body having an orifice that provides communication between a high-pressure side passage through which a cooling medium flows in and a low-pressure side passage through which the cooling medium flows out;

a valve element that adjusts the volume of the cooling medium flowing through said orifice;

an operating rod that operates said valve element in the valve opening direction; and a temperature-sensing drive section that drives said operating rod, wherein constraining means for constraining said valve element is disposed on the upstream side of the orifice of said high-pressure side passage;

wherein said valve element is formed in the shape of a ball and the constraining means is a support ring that supports the valve element.

2. The expansion valve according to claim 1, wherein said support ring comprises an elastically deformable, annular ring-shaped portion and a plurality of vibration-isolating springs and said vibration-isolating spring supports the valve element.

3. The expansion valve according to claim 1, wherein said support ring comprises upper and lower annular ring-shaped portions and a plurality of plate-like vibration-isolating springs formed by cutting said ring-shaped portions so as to protrude therefrom.

4. The expansion valve according to claim 1, wherein said support ring comprises one annular sing-shaped portion and a plurality of plate-like vibration-isolating springs disposed on one side of said ring-shaped portion.

5. The expansion valve according to claim 2, wherein said vibration-isolating spring is formed from a curved plate and the valve element is supported on the surface of the curved plate.

6. The expansion valve according to claim 1, wherein said support ring comprises a ring-shaped member made of a metallic elastic material and a slit or an overlapping portion, which enables the diametrical length thereof to be changed, is formed in said ring-shaped member.

7. An expansion valve comprising:

a valve body having an orifice that provides communication between a high-pressure side passage through which a cooling medium flows in and a low-pressure side passage through which the cooling medium flows out;

a valve element that adjusts the volume of the cooling medium flowing through said orifice;

an operating rod that operates said valve element in the valve opening direction;

a temperature-sensing drive section that drives said operating rod; and a support member that supports said valve element, wherein constraining means for constraining said support member is disposed on the upstream side of the orifice of said high-pressure side passage;

wherein said valve element is formed in the shape of a ball and said constraining means is a support ring that supports the valve element or/and the support member;

wherein said support ring comprises an elastically deformable, annular ring-shaped portion and a vibration-isolating spring and said vibration-isolating spring supports the valve element.

8. The expansion valve according to claim 7, wherein said support ring comprises upper and lower annular ring-shaped portions and plate-like vibration-isolating springs formed by cutting said ring-shaped portions so as to protrude therefrom.

9. The expansion valve according to claim 7, wherein said support ring comprises one annular ring-shaped portion and a plurality of plate-like vibration-isolating spring disposed on one side of said ring-shaped portion.

10. The expansion valve according to claim 7, wherein said vibration-isolating spring is formed from a curved plate and the valve element is supported on the surface of the curved plate.

* * * * *